US005638945A

United States Patent [19]

Fukinuki et al.

[11] Patent Number: 5,638,945

[45] Date of Patent: Jun. 17, 1997

[54] LOCKING TRIGGER MECHANISM FOR A PORTABLE POWER TOOL

[75] Inventors: Masatoshi Fukinuki, Clemson; Stephen M. DeMarco, Greenville, both of S.C.; James B. Watson, Conyers, Ga.

[73] Assignee: Ryobi North America, Inc., Easley, S.C.

[21] Appl. No.: 661,104

[22] Filed: Jun. 10, 1996

[51] Int. Cl.[6] ..... H01H 9/28

[52] U.S. Cl. ..... 200/43.17; 200/318.1; 200/321; 200/43.16

[58] Field of Search ..... 200/43.18, 43.17, 200/43.16, 318.1, 318, 318.2, 321, 322

[56] References Cited

U.S. PATENT DOCUMENTS

| | | | |
|---|---|---|---|
| 3,906,814 | 9/1975 | Mugnussen | 200/43.18 |
| 4,271,342 | 6/1981 | Sistare | 200/157 |
| 4,291,207 | 9/1981 | Reinke et al. | 200/42 R |
| 4,449,062 | 5/1984 | Wilson | 307/328 |
| 4,581,499 | 4/1986 | Cousins | 200/1 V |
| 4,820,889 | 4/1989 | Seghetti | 200/61.85 |
| 4,879,438 | 11/1989 | Winchester | 200/61.85 |
| 4,934,494 | 6/1990 | Fushiya et al. | 192/0.034 |
| 4,970,355 | 11/1990 | Haeusslein et al. | 200/50 B |
| 5,150,523 | 9/1992 | McCurry | 30/228 |
| 5,428,197 | 6/1995 | McCurry et al. | 200/318 |
| 5,577,600 | 11/1996 | Schoene et al. | 200/43.17 |

OTHER PUBLICATIONS

Sketch of Black & Decker Hedge Trimmer Lock-on/Lock-off Actuator -No Date.

1996 Black & Decker Outdoor Products Catalog

*Primary Examiner*—David J. Walczak

*Attorney, Agent, or Firm*—Brooks & Kushman P.C.

[57] ABSTRACT

A trigger mechanism for a portable electric power tool which can be selectively oriented in one of three states being a Locked-off, an On, and a Locked-on state. The trigger mechanism includes a trigger having a first latch portion and an actuator for actuating a switch for energizing a motor, a lock button having a second latch portion, a latch return spring, and a lock button return spring. The trigger is shiftable longitudinally between a Trigger-off and a Trigger-on position, while the lock button is shiftable transversely between a Button-off and a Button-on position. When the trigger mechanism is in the Locked-off state, the lock button is in the Button-off position preventing the trigger from moving from the Trigger-off position. When the trigger mechanism is in the On state, the lock button has been shifted to the Button-on position so that the trigger is shiftable to the Trigger-on position thereby actuating the switch. When the trigger mechanism is in the Locked-on state, the operator positions the first latch portion so that by releasing the trigger while in the On state the first and second latch portions engage.

20 Claims, 3 Drawing Sheets

LOCKING TRIGGER MECHANISM FOR A PORTABLE POWER TOOL

TECHNICAL FIELD

This invention relates to a locking trigger mechanism for a motor-driven portable electric power tool.

BACKGROUND ART

From the workshop, to the garden, to the kitchen, motor-driven portable electric power tools and appliances have provided society with the ability to perform large tasks at a relatively quicker pace than manual counterparts. Whether the tool is a hedge trimmer, a sander, or a kitchen carving knife, an operator may often require that the tool be maintained in an activated or On state for extended periods of time in order to accomplish a desired task.

As those skilled in the art recognize, on such occasions, the operator must keep the activation switch of the tool continuously actuated. This continuous actuation is typically achieved through force or pressure exerted by the operator's hand or fingers, eventually causing the operator to experience general fatigue and sore appendages. Therefore, various control mechanisms for portable power tools have been designed which incorporate a latching mechanism to allow the operator to lock the tool in an activated or On state.

It is also recognized in the art that, if handled in a certain manner, a portable electric power tool could become inadvertently engaged. Therefore, control mechanisms have been designed with these tools in mind which mandate the simultaneous actuation of two or more trigger devices in order to energize the motor of the tool. Thus, the likelihood of inadvertent activation of a tool is minimized by requiring the operator to perform a sequence of steps before the motor for operating the tool may become engaged.

Current control devices for portable power tools exist which require simultaneous actuation of components to activate the tool, as well as provide a feature to keep the tool activated in a locked on state. One such arrangement features a one-piece mechanism having two ends which each require activation in order to actuate the switch. Other prior art arrangements include U.S. Pat. No. 4,271,342 issued to Sistare; U.S. Pat. No. 4,291,207 issued to Reinke et al; U.S. Pat. No. 4,449,062 issued to Wilson; U.S. Pat. No. 4,820,889 issued to Seghetti; U.S. Pat. No. 4,879,438 issued to Winchester; U.S. Pat. No. 4,934,494 issued to Fushiya et al; and U.S. Pat. No. 5,150,523 issued to McCurry.

Consequently, a need has developed for an improved trigger mechanism which is capable of being locked in a Locked-on state so that the operator may operate the tool for extended periods of time without experiencing fatigue or accompanying soreness. In addition, the operator should be able to quickly and easily release the trigger mechanism from the Locked-on state.

Further, a need has developed for an improved trigger mechanism for a portable electric power tool which minimizes unwanted activation of the tool by requiring the simultaneous actuation of two separate elements of the mechanism in order to energize the motor of the tool.

SUMMARY OF THE INVENTION

It is a principle object of the present invention to provide an improved trigger mechanism for locking the portable electric power tool in an activated or On state whereby the tool may be maintained in continuous operation without any effort by the operator.

It is a further object of the present invention to provide an improved trigger mechanism so that the operator may quickly and easily release the trigger mechanism from the Locked-on state.

It is a further object of the present invention to provide an improved trigger mechanism for a portable electric power tool which assists in preventing inadvertent activation of the tool.

It is still a further object of the present invention to provide an improved trigger mechanism which requires the user to perform two distinct and opposite motions to operate the tool.

In carrying out the above objects, features and advantages of the present invention, the trigger mechanism is included in a portable electric power tool having a handle, an implement, an electric motor and a switch in electrical communication with the electric motor for energizing the electric motor. In a preferred embodiment, the tool is an electric hedge trimmer having an elongated cutting bar as its implement, and further where the handle of the tool incorporates the trigger mechanism of the present invention. The handle further provides for a handle front surface and a handle rear surface.

The trigger mechanism for the tool can be selectively oriented in one of three states: an Off state, an On state and a Locked-on state. The trigger mechanism includes a trigger which has a first abutment member, a first engagement surface, an actuator for contacting the switch which energizes the electric motor, and a latch arm which has a first latch portion. The trigger is pivotally mounted to the housing at a pivot point.

The trigger mechanism further includes a lock button having a second abutment member for cooperating with the first abutment member, a second latch portion and a second engagement surface. In a preferred embodiment, one of either the first abutment member or the second abutment member includes a stepped portion having a high region and a low region. The abutment member having the stepped region cooperates with the other abutment member. For purposes of discussion, the lock button having the second abutment member is designated as having the stepped portion which cooperates with the first abutment member of the trigger.

Further included in the trigger mechanism is a latch return spring and a lock button return spring, each being mounted to the trigger. The latch return spring serves to bias the latch arm away from the lock button, while the lock button return spring serves to simultaneously bias the lock button to its Button-off position and the trigger to its Trigger-off position.

When the trigger mechanism is in the Locked-off state, the high region of the lock button cooperates with the first abutment member of the trigger, thereby preventing any movement of the trigger. The lock button return spring additionally keeps the lock button biased to its Button-off position while also keeping the trigger biased to its Trigger-off position. The activation of the switch, and in turn, the energizing of the electric motor are also impeded as a result of the inability of the trigger to move.

When the operator desires to activate the tool, the operator contacts the second engagement surface of the lock button, which projects from a rear opening of the handle rear surface. The operator is thus able to shift the lock button forward to its Button-on position. As a result, the high region of the stepped portion is correspondingly shifted forward. This in turn allows the operator to depress the trigger via the first engagement surface which projects from a front opening of the handle front surface. By depressing the trigger, the trigger moves in a predetermined path and as a result permits the actuator to pivot around the pivot point and activate (or actuate) the contact button of the switch, thereby energizing the electric motor.

For orienting the trigger mechanism in the Locked-On state, the operator manually moves the latch arm, which is projecting from the rear opening, rearward and against the natural bias of the latch return spring. Once in position, the operator may release the trigger so that the first latch portion engages the second latch portion of the lock button. These latch portions are preferably interlocking j-hook shaped components. The trigger mechanism is thereby maintained in the Locked-on state.

The above objects and other objects, features and advantages of the present invention are readily apparent from the following detailed description of the best modes for carrying out the invention when taken in connection with the accompanying drawings wherein like reference numerals correspond to like components.

BEST MODE FOR CARRYING OUT THE INVENTION

Figure 1:
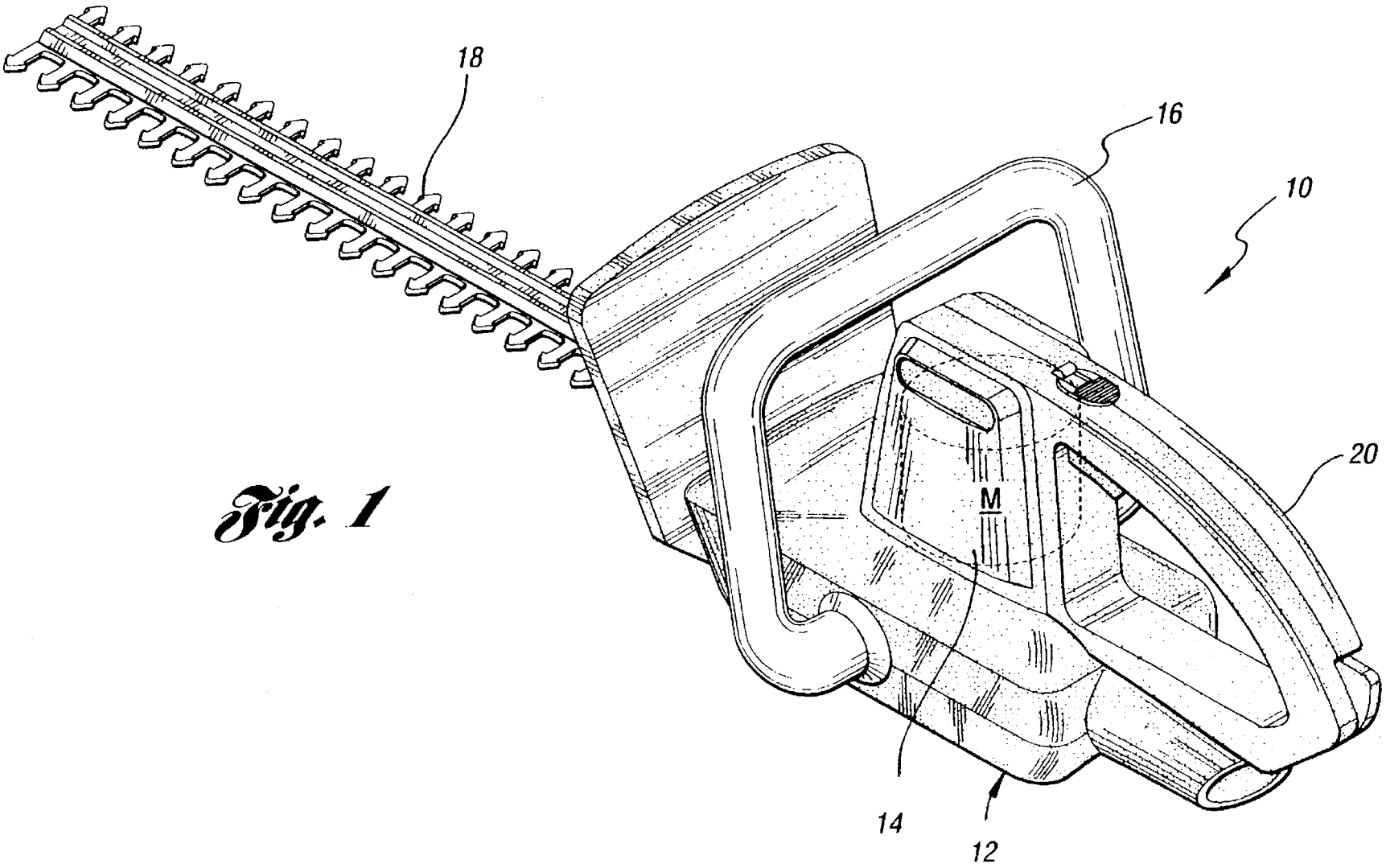
FIG. 1 is a perspective view of a hedge trimmer incorporating a trigger mechanism according to the present invention.

FIG. 1 illustrates a portable electric power tool which incorporates the trigger mechanism of the present invention. The portable electric power tool is representatively shown as an electric hedge trimmer 10. However, the present invention may of course be applicable to any portable electric power tool, appliance or apparatus that is capable of incorporating the trigger mechanism disclosed herein. Such power tools and appliances may include, but are not limited to, tools used for gardening and landscaping, such as sprayers and hedge trimmers; tools used in the workshop, such as drills, sanders and grinders; and appliances used in the kitchen, such as carving knives or mixers. The above are mentioned by way of example, as the present invention contemplates that the portable power tool may be any type of motor-driven portable electric apparatus.

Figure 2:
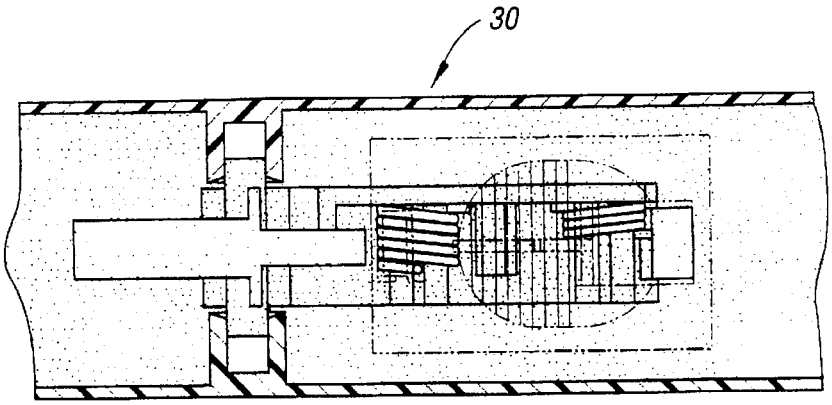
FIG. 2 is a top plan view of a trigger mechanism according to the present invention.

As further illustrated in FIG. 1, electric hedge trimmer 10 includes a housing 12, an electric motor 14 (shown in phantom), a support handle 16, and a motor-driven implement shown as cutter bar 18. However like the power tool itself, the implement may be a saw blade, sanding pad or any other appropriate tool or appliance implement. As seen, housing 12 further includes handle 20. Housing 12 is preferably an injection molded plastic part comprising two mating sections or halves. FIG. 2 illustrates a plan view of the trigger mechanism 30 of the present invention.

The trigger mechanism 30 of the present invention activates a switch (not shown in FIGS. 1–2) to operate and energize electric motor 14. The trigger mechanism 30 can be selectively oriented in one of three states, those being a Locked-Off state (as more fully discussed below in association with FIG. 3), an On state (as more discussed below in association with FIGS. 4–6), and a Locked-on state (as more fully discussed below in association with FIGS. 6–7).

A first preferred embodiment of the trigger mechanism 30 of the present invention is illustrated in various stages of operation in FIGS. 3–7. As more fully shown in FIG. 3, the trigger mechanism 30 includes trigger 32, lock button 34, latch return spring 36 and lock button return spring 38. Trigger 32 is mounted relative to housing 12 and is shiftable longitudinally along a predetermined path between a Trigger-off position and a Trigger-on position. Trigger 32 has a first engagement surface 40 projecting from handle 20 for actuation by an operator of the hedge trimmer 10. More particularly, handle 20 includes a handle front surface 42 (or front surface) which has a front opening 44 through which first engagement surface 40 projects. Handle 20 further includes a handle rear surface 46 (or rear surface) which has a rear opening 48.

Figure 3:
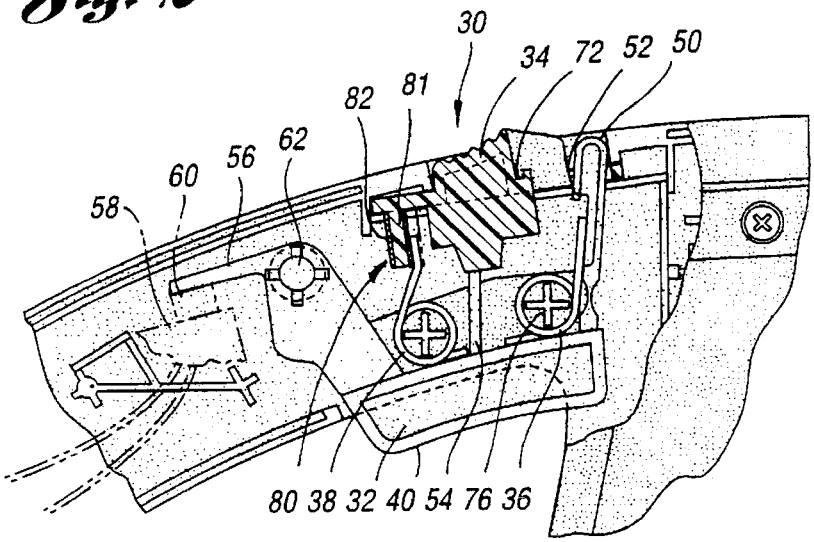
FIG. 3 is a side view of a trigger mechanism according to the present invention shown in its Locked-off state.

Trigger 32 further includes an latch arm 50 having a first latch portion 52. Latch arm 50 is typically recessed within the housing when the trigger mechanism is in the Locked-off state. While latch arm 50 is shown as being integral with trigger 32, it may in other embodiments be a discrete element mechanically connected to trigger 32. The first latch portion 52 is preferably in the shape of a j-hook for reasons discussed more clearly herein. Trigger 32 more fully includes a first abutment member 54 and an actuator 56, the actuator 56 for cooperating with switch 58, or more particularly for cooperating with a contact button 60 of switch 58 as shown in FIG. 3.

Actuator 56 operates to depress contact button 60 of switch 58 as the trigger mechanism 30 shifts or changes orientation from the Locked-off state to the On state. Preferably trigger 32 is mounted to housing 12 at pivot point 62. Thereby actuator 56 can pivotally move about pivot point 62 disposed between the actuator 56 and the first engagement surface 40. As a result, switch 58 may be disposed in handle 20 remote from the first engagement surface 40, as shown in FIGS. 3–7.

As further shown in FIGS. 2–7 and as representatively illustrated by FIG. 3, trigger mechanism 30 further includes a lock button 34 mounted relative to housing 12 and shiftable transversely between a Button-off position (as more fully discussed below in association with FIG. 3) and a Button-on position (as more fully discussed below in association with FIGS. 4–7). The transverse movement of the lock button 34 may also be described as being shiftable along an axis transverse to the movement of trigger 32. In a preferred embodiment, the lock button 34 may move within a guide or cavity 64 formed in housing 12. Both trigger 32 and lock button 34 are preferably formed of an injection molded plastic.

Lock button 34 includes a second engagement surface 74 projecting from the housing 12 for actuation or engagement by the operator as illustrated in FIGS. 3–7. Because lock button 34 is intended to be actuated by the thumb of the operator under normal conditions, second engagement surface 74 is ribbed in order to provide traction for the operator. Lock button 34 also has a second abutment member 66 which cooperates with the first abutment member 54 of the trigger 32. In a preferred embodiment, one of either the first abutment member 54 or the second abutment member 66 is a stepped portion or area 67. Stepped portion 67 more particularly has a high region 68 and a low region 70. Lock button 34 further includes a second latch portion 72 which cooperates with the first latch portion 52 of the trigger 32 and is also in the shape of a j-hook.

As previously mentioned and as illustrated in FIGS. 3–7, trigger mechanism 30 includes a latch return spring 36 and a lock button return spring 38. Each spring 36 and 38 is metallic and is mounted on or to trigger 32. Each spring 36 and 38 may either be discrete elements or integral to trigger 32 or trigger mechanism 30. Latch return spring 36 is a metallic coil or torsion spring mounted to trigger 32. In the embodiment shown, latch return spring 36 is mounted to trigger 32 at a first boss 76 which is appropriately sized to fit the coil diameter of latch return spring 36. In another embodiment, latch return spring 36 may be mounted by molding it into trigger 32 or trigger mechanism 30. It should be appreciated that latch return spring 36 may also be mounted to the housing 12 without departing from the spirit of the invention. Latch return spring 36 biases latch arm 50 and first latch portion 52 forward and away from the second latch portion 72 when the trigger mechanism 30 is in the Locked-off state.

Lock button return spring 38 is a metallic coil or torsion spring mounted to the trigger 32 for biasing the lock button 34 rearward toward its Button-off position and the trigger 32 downward toward its Trigger-off position, when the trigger mechanism 30 is in its Locked-off state. In the embodiment shown in FIGS. 3–7, lock button return spring 38 biases lock button 34 at bias member 80. Bias member 80 is comprised of a wall portion 81 of lock button 34. In another embodiment, wall portion 81 may be surrounded or encompassed by, either partially or wholly, a metallic sleeve or clip 82 to act as a bearing surface. Bias member 80 thus provides support to the leg 86 of lock button return spring 38. Lock button return spring 38 is mounted to trigger 32 at a second boss 78 which is appropriately sized to fit the coil diameter of lock button return spring 38. In another embodiment, lock button return spring 38 is a leaf spring mounted by molding it into trigger 32, or trigger mechanism 30.

Figure 4:
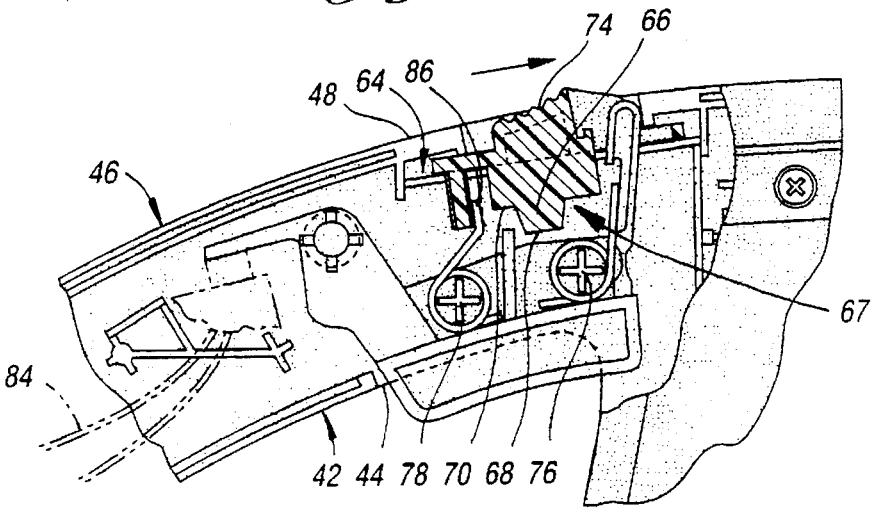
FIG. 4 is a side view of a trigger mechanism according to the present invention showing the trigger mechanism moving from its Locked-off state to its On state as the lock button is shiftably translated forward.

It should be noted that the direction designated as forward is generally the direction of the arrow in FIG. 4, being the direction toward the cutter bar 18. Rearward and downward, given their ordinary meanings, are best illustrated by the arrows in FIG. 7.

FIG. 3 shows the trigger mechanism in the Locked-off state (which may also be referred to as the rest, normal or inactive state.) In the Locked-off state, trigger 32 is maintained in the Trigger-off position by the lock button 34 which is in its Button-off position. As shown in FIG. 3, in the Locked-off state, lock button 34 prevents the operator from being able to squeeze or depress trigger 32 into the Trigger-on position. More particularly and as previously stated, lock button 34 has a second abutment member 66 which prevents the first abutment member 54 of trigger 32 from moving longitudinally (or upward) and along its predetermined path.

Again, one of either the first abutment member 54 or the second abutment member 66 may include stepped portion 67, which cooperates with the opposing one of either the first or second abutment member 54 or 67. However, for the purposes of our explanation and as referenced in FIGS. 3–7, second abutment member 66 of lock button 34 is representatively shown as being or having stepped portion 67. In operation and as shown in FIG. 3, when first abutment member 54 contacts or abuts the high region 68 of stepped portion 67, the operator is unable to depress the trigger 32 into the Trigger-on position. The lock button 34 thereby prevents trigger 32 from being depressed to the Trigger-on position.

FIG. 4 illustrates the trigger mechanism 30 being shifted or oriented from the Locked-off state to the On state. As previously shown in FIG. 3, lock button 34 is spring-biased into its Button-off position by the lock button return spring 38. Referring to FIG. 4, the operator shifts lock button 34 from its Button-off position to the Button-on position in the direction of the arrow The arrow in FIG. 4 is designated as forward and toward cutter bar 18. As the lock button is shiftably translated forward, the high region 68 of stepped portion 67 is correspondingly shifted forward in the direction of the arrow. In this orientation, first abutment member 54 of trigger 32 no longer contacts or abuts high region 68. The operator is therefore free to depress trigger 32 as explained more fully in the discussion accompanying FIG. 5.

Figure 5:
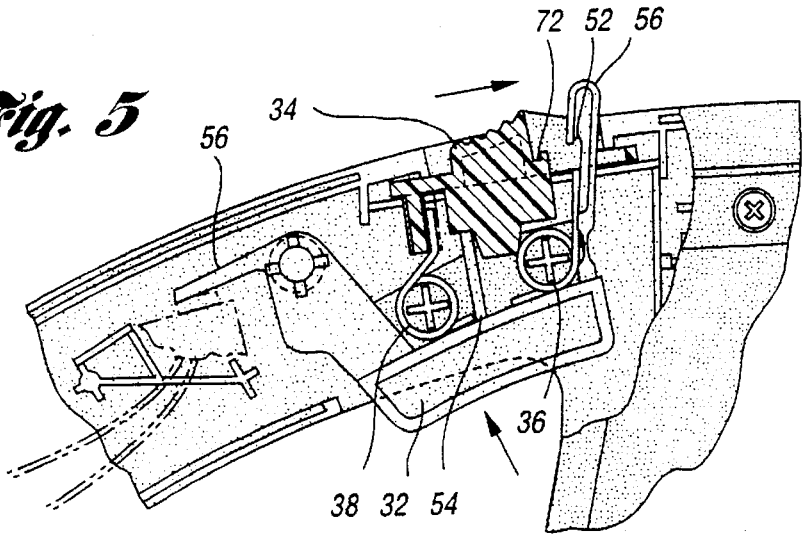
FIG. 5 is a side view of a trigger mechanism according to the present invention showing the trigger mechanism in its On state as the trigger is depressed and the lock button is translated forward.

As shown in FIGS. 3–7, and in particular referring to FIG. 5, trigger 32 is positioned so that it is intended to be squeezed by the index and/or middle finger of the operator. By depressing trigger 32 upward in the direction of the arrow shown in FIG. 5, the first abutment member 54 shifts longitudinally along its predetermined path toward and in cooperation with low region 70. Simultaneously, actuator 56 pivots around pivot point 62 thereby contacting and depressing contact button 60 of switch 58. As a result of depressing contact button 60, the electrical circuit is closed. This in turn energizes electric motor 14 via electrical wiring 84, which provides the electrical communication between switch 58 and electric motor 14.

While actuator 56 is shown as being integral with trigger 32, it is appreciated that actuator 56 may also comprise a discrete element mounted to trigger 32. Moreover, while actuator 56 is shown in FIGS. 3–7 as a remote arm of trigger 32, depending on the location of the switch 58 and the contact button 60, actuator 56 may be disposed at any location on the trigger 32 which provides sufficient displacement to actuate the switch 58.

Figure 6:
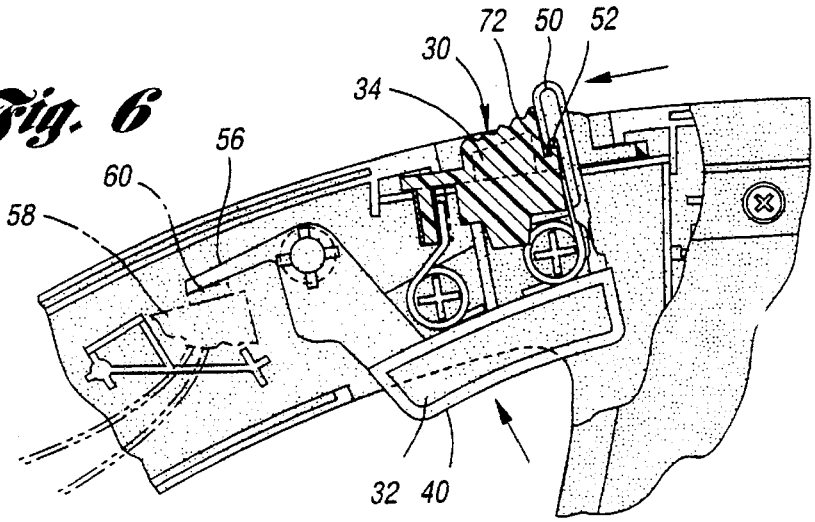
FIG. 6 is a side view of a trigger mechanism according to the present invention showing the trigger mechanism in its On state and approaching its Locked-on state.

FIG. 6 illustrates the mode of operation whereby the operator is orienting the trigger mechanism 30 from the On state to the Locked-on state. Trigger mechanism 30 may be oriented to the Locked-on state when lock button 34 is shifted forward to the Button-on position and when trigger 32 is depressed to its Trigger-on position as discussed above in association with FIG. 5. To achieve the Locked-on orientation and as illustrated in FIG. 6, first latch portion 52 of latch arm 50 is engaged or actuated by the operator and moved rearward in the direction of the arrow so that first latch portion 52 is in a position from which it may be latched or engaged with second latch portion 72.

As previously mentioned, latch arm 50 is normally spring biased by latch return spring 36 into its ineffective position as shown in FIGS. 3–5. From this position, FIG. 6 illustrates that latch arm is displaced rearward against this bias in the direction of the arrow so that its first latch portion 52 properly positioned for attachment to the second latch portion 72. The latch portions 52 and 72 are preferably a pair of interlocking j-hook shaped components for ease of latching and unlatching.

Figure 7:
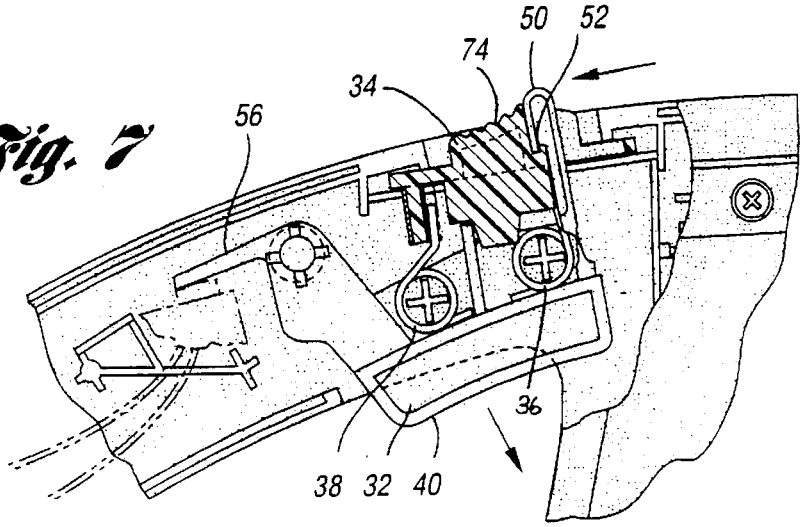
FIG. 7 is a side view of a trigger mechanism according to the present invention showing the trigger mechanism in its Locked-on state and the trigger returning to its Trigger-off or rest position.

The orientation of the trigger mechanism in the Locked-on state is shown in FIG. 7. From the position shown in FIG. 6 the operator releases the trigger 32 or its first engagement surface 40, allowing the trigger 32 to drop slightly downward along its predetermined path toward the Trigger-off position. Being part of trigger 32, first latch portion 52 likewise drops downward to engage second latch portion 72, allowing the respective j-hook shaped components to latch together. As a result, lock button 34 and latch arm 50 are thereby locked together.

Significant about the Locked-on state is the ability of the operator in this state to release the trigger while the switch 58 continues to be actuated and the electric motor 14 continues to be engaged. The operator is therefore able to operate the power tool while not experiencing the fatigue and soreness typically associated with having to depress the tool's switch mechanism for an extended period of time.

To release the trigger mechanism 30 from the Locked-on state, the operator need only pull or depress the trigger 32 even slightly. This displaces or shifts the trigger slightly upward whereby the first latch portion 52 disengages from the second latch portion 72. As a result, latch return spring 36 is free to bias the latch arm 50 back to its inactive position. The trigger thus acts as a lock release, causing the first and second latch portions 52 and 72 to disengage. If the operator continues to depress the trigger 32 after the disengagement of the latch portions 52 and 72, the trigger mechanism continues to operate in the On state, as previously discussed in association with FIG. 5.

However, if the operator releases the trigger 32 after the disengagement of the latch portions 52 and 72, the trigger mechanism returns to the Lock-off state. In the this scenario, lock button return spring 38 simultaneously biases the lock button 34 rearward to the Button-off position and the trigger downward to the Trigger-off position. The result is the Lock-off state as previously discussed in association with FIG. 3.

While the best mode for carrying out the invention has been described in detail, those familiar with the art to which this invention relates will recognize various alternative designs and embodiments for practicing the invention as defined by the following claims.

What is claimed is:

1. A trigger mechanism for use in a portable electric power tool having a housing, the trigger mechanism which activates a switch to operate an electric motor can be selectively oriented in one of three states, a Locked-off state, an On state, and a Locked-on state, the trigger mechanism comprising:

a trigger mounted relative to a power tool housing and shiftable longitudinally along a predetermined path between a Trigger-on and a Trigger-off position, the trigger having a first engagement surface projecting from the housing for actuation by an operator of the portable electric power tool, a latch arm with a first latch portion, an actuator for cooperating with a switch, and a first abutment member;

a lock button mounted relative to the housing and shiftable transversely between a Button-off and a Button-on position, the lock button having a second abutment member which cooperates with the first abutment member, a second latch portion which cooperates with the first latch portion, and a second engagement surface projecting from the housing for actuation by the operator;

a lock button return spring mounted to the trigger for biasing the lock button rearward to its Button-off position and the trigger downward to its Trigger-off position when the trigger mechanism is in the Locked-off state; and a latch return spring mounted to the trigger for biasing the latch arm when the trigger mechanism is in the Locked-off state, whereby when the trigger mechanism is in the Locked-off state the trigger is maintained in the Trigger-off position and is prevented from moving by the lock button which is in the Button-off position, when the trigger mechanism is moved to the On state, the second engagement surface is actuated and the lock button is shiftably translated by the operator from the Button-off to the Button-on position and the first engagement surface is actuated and the trigger is depressed by the operator for movement from the Trigger-off to the Trigger-on position, when the trigger mechanism is moved from the On state to the Locked-on state, the first latch portion is oriented and the trigger is released by the operator so the first latch portion and the second latch portion engage, and to release the trigger mechanism from the Locked-on state, the operator engages the first engagement surface and depresses the trigger.

2. The trigger mechanism of claim 1, wherein the housing includes a handle having a front surface and a rear surface, the front surface having a front opening through which the first engagement surface of the trigger projects for actuation by the operator, and the rear surface having a rear opening through which the second engagement surface of the lock button projects for actuation by the operator.

3. The trigger mechanism of claim 2, wherein the latch arm protrudes from the rear opening for actuation by the operator to engage the first latch portion to the second latch portion, when the trigger mechanism is in the On and Locked-on states and wherein the latch arm is recessed in the housing when the trigger mechanism is in the Locked-off state.

4. The trigger mechanism of claim 1, wherein one of said first abutment member or second abutment member is a stepped portion, the stepped portion having a high region and a low region, the high region cooperating with the opposing one of said first abutment member or second abutment member when the trigger mechanism is in the Locked-off state, and the low region cooperating with the opposing one of either said first abutment member or second abutment member when the trigger mechanism is in the On and Locked-on states.

5. The trigger mechanism of claim 1, wherein the latch return spring is a discrete element mounted on the trigger.

6. The trigger mechanism of claim 1, wherein the lock button return spring is a discrete element mounted on the trigger.

7. The trigger mechanism of claim 1, wherein the trigger is mounted to the housing at a pivot point around which the actuator pivots for actuating the switch when the trigger mechanism moves from the Locked-off to the On and Locked-on states.

8. The trigger mechanism of claim 1, wherein the first latch portion and the second latch portion are interlocking j-hook shaped components which engage to lock the lock button and the trigger together when the trigger mechanism is in the Locked-on state.

9. An electric hedge trimmer selectively oriented in one of three states, a Locked-off state, an On state, and a Locked-on state, the electric hedge trimmer comprising:

a housing;

an elongated cutting bar mounted to the housing;

an electric motor disposed within the housing for operating the elongated cutting bar;

a switch disposed within the housing and in electrical communication with the electric motor for energizing the electric motor; and a trigger mechanism disposed within the housing for activating the switch, the trigger mechanism includes:

a) a trigger mounted relative to the housing and shiftable longitudinally along a predetermined path between a Trigger-on and a Trigger-off position, the trigger having a first engagement surface projecting from the housing for actuation by an operator of the electric hedge trimmer, a latch arm with a first latch portion, an actuator for cooperating with a switch, and a first abutment member, b) a lock button mounted relative to the housing and shiftable transversely in a guide between a Button-off and a Button-on position, the lock button having a second abutment member which communicates with the first abutment member, a second latch portion which cooperates with the first latch portion, and a second engagement surface projecting from the housing for actuation by the operator;

c) a lock button return spring mounted to the trigger for biasing the lock button rearward to its Button-off position and the trigger downward to its Trigger-off position, when the trigger mechanism is in the Locked-off state; and d) a latch return spring mounted to the trigger for biasing the latch arm when the trigger mechanism is in the Locked-off state, whereby when the electric hedge trimmer is in the Locked-off state the trigger is maintained in the Trigger-off position and is prevented from moving by the lock button which is in the Button-off position, when the electric hedge trimmer is moved to the On state, the second engagement surface is actuated and the lock button is shiftably translated by the operator from the Button-off to the Button-on position and the first engagement surface is actuated and the trigger is depressed by the operator for movement from the Trigger-off to the Trigger-on position, when the electric hedge trimmer is moved from the On state to the Locked-on state, the first latch portion is oriented and the trigger is released by the operator so the first latch portion and the second latch portion engage, and to release the electric hedge trimmer from the Locked-on state, the operator engages the first engagement surface and depresses the trigger.

10. The electric hedge trimmer of claim 9, wherein the housing includes a handle having a front surface and a rear surface, the front surface having a front opening through which the first engagement surface of the trigger projects for actuation by the operator, and the rear surface having a rear opening through which the second engagement surface of the lock button projects for actuation by the operator.

11. The electric hedge trimmer of claim 10, wherein the latch arm protrudes from the rear opening for actuation by the operator when the electric hedge trimmer is in the On and Locked-on states to engage the first latch portion to the second latch portion, and wherein the latch arm is recessed in the housing when the electric hedge trimmer is in the Locked-off state.

12. The electric hedge trimmer of claim 9, wherein one of said first abutment member or second abutment member is a stepped portion, the stepped portion having a high region and a low region, the high region cooperating with the opposing one of said first abutment member or second abutment member when the electric hedge trimmer is in the Locked-off state, and the low region cooperating with the opposing one of either said first abutment member or second abutment member when the electric hedge trimmer is in the On and Locked-on states.

13. The electric hedge trimmer of claim 9, wherein the latch return spring is a discrete element mounted on the trigger.

14. The electric hedge trimmer of claim 9, wherein the lock button return spring is a discrete element mounted on the trigger.

15. The electric hedge trimmer of claim 9, wherein the trigger is mounted to the housing at a pivot point around which the actuator pivots for actuating the switch when the electric hedge trimmer moves from the Locked-off to the On and Locked-on states.

16. The electric hedge trimmer of claim 9, wherein the first latch portion and the second latch portion are interlocking j-hook shaped components which engage to lock the lock button and the trigger together when the electric hedge trimmer is in the Locked-on state.

17. A trigger mechanism for use in a portable electric power tool having a housing which includes a handle having a front surface and a rear surface, the front surface having a front opening, the rear surface having a rear opening, the trigger mechanism for actuating a switch to operate an electric motor which can be selectively oriented in one of three states, being a Locked-off state, an On state and a Locked-on state, the trigger mechanism comprising:

a trigger mounted relative to the power tool housing at a pivot point and shiftable longitudinally between a Trigger-off and a Trigger-on position, the trigger having a first engagement surface projecting from the front opening for actuation by an operator of the power tool, a latch arm having a first latch portion, an actuator for cooperating with the switch, and a first abutment member;

a lock button mounted relative to the power tool housing and shiftable transversely between a Button-off and a Button-on position, the lock button having second abutment member which is a stepped portion for cooperating with the first abutment member of the trigger, a second latch portion which is engageable with the first latch portion, and a second engagement surface projecting from the rear opening for actuation by the operator, the stepped portion having a high region and a low region, the high region cooperating with the first abutment member when the trigger mechanism is in the Locked-off state, and the low region cooperating with the first abutment member when the trigger mechanism is in the On and Locked-on states;

a lock button return spring mounted to the trigger for biasing the lock button to its Button-off position and the trigger to its Trigger-off when the trigger mechanism is in the Locked-off state; and a latch return spring mounted to the trigger for biasing the latch arm when the trigger mechanism is in the Locked-off state, whereby when the trigger mechanism is in the Locked-off state the trigger is maintained in the Trigger-off position and is prevented from moving by the lock button which is in the Button-off position, when the trigger mechanism is moved to the On state, the second engagement surface is actuated and the lock button is shiftably translated by the operator from the Button-off to the Button-on position and the first engagement surface is actuated and the trigger is depressed by the operator for movement from the Trigger-off to the Trigger-on position, when the trigger mechanism is moved from the On state to the Locked-on state, the first latch portion is oriented and the trigger is released by the operator so the first latch portion and the second latch portion engage, and to release the trigger mechanism from the Locked-on state, the operator engages the first engagement surface and depresses the trigger.

18. The trigger mechanism of claim 17, wherein the latch return spring is a discrete element mounted on the trigger.

19. The trigger mechanism of claim 17, wherein the lock button return spring is a discrete element mounted on the trigger.

20. The trigger mechanism of claim 17, wherein the first latch portion and the second latch portion are interlocking j-hook shaped components which engage to lock the lock button and the trigger together when the trigger mechanism is in the Locked-on state.

* * * * *